US012110081B1

(12) United States Patent
Zhao

(10) Patent No.: US 12,110,081 B1
(45) Date of Patent: Oct. 8, 2024

(54) FLOATING DEVICE

(71) Applicant: MAYFLOWER INDUSTRIAL INC, Hasty, CO (US)

(72) Inventor: Wei Zhao, Heilongjiang (CN)

(73) Assignee: MAYFLOWER INDUSTRIAL INC, Hasty, CO (US)

( * ) Notice: Subject to any disclaimer, the term of this patent is extended or adjusted under 35 U.S.C. 154(b) by 0 days.

(21) Appl. No.: 18/398,889

(22) Filed: Dec. 28, 2023

(30) Foreign Application Priority Data

Sep. 4, 2023 (CN) ..... 202322396105.0

(51) Int. Cl.
*B63B 34/52* (2020.01)
*B63B 7/08* (2020.01)
*B63B 34/50* (2020.01)

(52) U.S. Cl.
CPC ..... *B63B 34/52* (2020.02); *B63B 7/08* (2013.01); *B63B 34/50* (2020.02)

(58) Field of Classification Search
CPC ..... B63B 34/50; B63B 34/52; B63B 7/08; A47C 15/006
See application file for complete search history.

(56) References Cited

U.S. PATENT DOCUMENTS 1,329,687 A * 2/1920 Underwood ..... A47C 15/006 5/706
5,411,425 A * 5/1995 Rinker ..... B63B 43/14 441/130
5,571,036 A * 11/1996 Hannigan ..... B63B 34/50 441/132
5,791,958 A * 8/1998 Yeung ..... A47C 15/006 441/130
10,011,330 B2 * 7/2018 Osimo ..... B63B 34/00
D978,273 S * 2/2023 Liao ..... D21/809
2014/0024273 A1 * 1/2014 Marcantonio ..... B63B 34/52 441/129

FOREIGN PATENT DOCUMENTS

DE 202020106742 U1 * 1/2021
JP 2021172113 A * 11/2021

* cited by examiner

*Primary Examiner* — Ajay Vasudeva
(74) *Attorney, Agent, or Firm* — ScienBiziP, P.C.

(57) ABSTRACT

A floating device is provided. The floating device includes: a floating member comprising a first end and a second end arranged opposite to the first end; and a pair of inflatable members attached to the first end and the second end of the floating member respectively and configured to be inflatable, each of the pair of inflatable members is formed by a single sheet, each of the pair of inflatable members includes an upper wall and a lower wall formed by bending the single sheet, the upper and the lower walls overlap with each other, a sealed cavity is formed by connecting a first free edge of the upper wall to a second free edge of the lower wall, the first end and the second end are sandwiched between the upper wall and the lower wall of a corresponding one of the pair of inflatable members.

11 Claims, 9 Drawing Sheets

FLOATING DEVICE

CROSS-REFERENCE TO RELATED APPLICATIONS

This application claims the benefit of priority to Chinese Patent Application Number 202322396105.0 filed on Sep. 4, 2023, in the China National Intellectual Property Administration. The entire contents of the above-identified application are hereby incorporated by reference.

TECHNICAL FIELD

The disclosure relates to water inflatable device, and in particular to a floating device.

BACKGROUND

With the continuous development and progress of the society, there are more and more types of water entertainment activities, and the types of inflatable water products are also increasing. Floating rafts are very popular entertainment product on a beach or a pool. At present, the floating raft on the market usually includes two inflatable cavities and a mesh fabric located between the two inflatable cavities. Buoyancy exerted on the two inflatable cavities is sufficient to cause the floating raft to float on the water, so that users can lie on the mesh fabric. However, each of the inflatable cavities of the floating raft is usually formed by at least two sheets, thereby making the manufacturing process of the floating raft more complicated and causing material waste during the manufacturing process.

SUMMARY OF DISCLOSURE

The present disclosure provides a floating device with a simple structure and manufacturing process.

The present disclosure provides a floating device, the floating device includes: a floating member comprising a first end and a second end arranged opposite to the first end; and a pair of inflatable members attached to the first end and the second end of the floating member respectively and configured to be inflatable, each of the pair of inflatable members is formed by a single sheet, each of the pair of inflatable members includes an upper wall and a lower wall formed by bending the single sheet, the upper and the lower walls overlap with each other, a sealed cavity is formed by connecting a first free edge of the upper wall to a second free edge of the lower wall, the first end and the second end are sandwiched between the upper wall and the lower wall of a corresponding one of the pair of inflatable members, and the first end and the second end are respectively connected with the upper wall and the lower wall.

In some embodiments, the first free edge of the upper wall includes a first connecting edge, a first upper edge and a second upper edge, both ends of the first connecting edge are respectively connected to the first upper edge and the second upper edge, the second free edge of the lower wall includes a second connecting edge, and a first lower side edge and a second lower side edge, both ends of the second connecting edge are respectively connected to the first lower side edge and the second lower side edge, the floating device further includes a first connected portion, a second connected portion, and a third connected portion, wherein the first connecting edge of the upper wall and the second connecting edge of the lower wall are connected together to form the first connected portion, the first upper edge of the upper wall and the first lower edge of the lower wall are connected together to form the second connected portion, the second upper edge of the upper wall and the second lower edge of the lower wall are connected together to form the third connected portion, and the sealed cavity is formed by connecting the second connected portion and the third connected portion to respective side of the first connected portion respectively.

In some embodiments, at least one of the second connected portion and the third connected portion is arc shaped.

In some embodiments, further includes a fourth connected portion formed by connecting the first connecting edge of the upper wall, the second connecting edge of the lower wall, and the first end of the floating member, wherein the first connecting edge of the upper wall, the second connecting edge of the lower wall, and the second end of the floating member are connected to form the fourth connected portion, and the fourth connected portion is closer to a centerline in a length direction of the floating device than the first connected portion.

In some embodiments, the fourth connected portion is parallel to the first connected portion.

In some embodiments, a bend portion is formed at each end of the fourth connected portion, each of the bend portion is connected to a corresponding end of the first connected portion.

In some embodiments, the upper wall includes a first connecting edge, a first upper edge and a second upper edge located on respective sides of the first connecting edge, the lower wall includes a second connecting edge, and a first lower side edge and a second lower side edge located on respectively sides of the second connecting edge, the floating device further includes a first connected portion, a second connected portion, and a third connected portion, wherein the first connecting edge of the upper wall, the second connecting edge of the lower wall, and the first end or the second end of the floating member are connected together to form the first connected portion, the first upper edge of the upper wall and the first lower edge of the lower wall are connected together to form the second connected portion, the second upper edge of the upper wall and the second lower edge of the lower wall are connected together to form the third connected portion, and the sealed cavity is formed by connecting the second connected portion and the third connected portion to respectively sides of the first connected portion.

In some embodiments, the floating device further includes a pair of intake components respectively installed on the pair of inflatable members.

In some embodiments, the floating member further includes a cloth defining a plurality of holes.

In some embodiments, the floating member further includes at least one cladding member, the at least one cladding member is configured to cover an edge of the cloth that is not connected to the inflatable member.

The present disclosure further provides a floating device, the floating device includes: a floating member; and at least one inflatable member arranged on the floating member and configured to be inflatable, the at least one inflatable member is formed by bending a single sheet, each of the at least one inflatable member includes a sealed cavity, the at least one inflatable member is equipped with an intake component.

In some embodiments, each of the at least one inflatable member includes an upper wall and a lower wall by bending the single sheet, and the upper and the lower walls overlap with each other, the sealed cavity is formed by connecting a first free edge of the upper wall to a second free edge of the lower wall.

In some embodiments, the first free edge of the upper wall includes a first connecting edge, a first upper edge and a second upper edge, both ends of the first connecting edge are respectively connected to the first upper edge and the second upper edge, the second free edge of the lower wall includes a second connecting edge, and a first lower side edge and a second lower side edge, both ends of the second connecting edge are respectively connected to the first lower side edge and the second lower side edge, the floating device further includes a first connected portion, a second connected portion, and a third connected portion, wherein the first connecting edge of the upper wall and the second connecting edge of the lower wall are connected together to form the first connected portion, the first upper edge of the upper wall and the first lower edge of the lower wall are connected together to form the second connected portion, the second upper edge of the upper wall and the second lower edge of the lower wall are connected together to form the third connected portion, and the sealed cavity is formed by connecting the second connected portion and the third connected portion to respective sides of the first connected portion.

In some embodiments, at least one of the second connected portion and the third connected portion is arc shaped.

The present disclosure further provides a floating device, comprising: a floating member comprising a first end and a second end arranged opposite to the first end; and a pair of inflatable members attached to the first end and the second end of the floating member respectively and configured to be inflatable, each of the pair of inflatable members is formed by bending a single sheet.

Compared with the prior art in which a plurality of sheets are connected together to form an inflatable member, the inflatable member of the present disclosure is composed of the single sheet, the structure of the inflatable member is simple, and it can quickly align with the upper wall and the lower wall during the manufacturing process, thereby improving the production efficiency.

BRIEF DESCRIPTION OF DRAWINGS

The drawings illustrate the embodiments and form a part of the specification, together with a written description of the specification, to explain the exemplary embodiment of the embodiment. It is obvious that the drawings in the following description are only some embodiments of the present disclosure. For ordinary technical personnel in the art, other drawings can be obtained based on these drawings without any creative labor. In all drawings, the same reference numerals refer to similar but not necessarily identical elements.

DETAILED DESCRIPTION

In order to make the purpose, technical solution, and advantages of the present disclosure clearer, further detailed descriptions will be given below in conjunction with the accompanying drawings. Obviously, the described implementation methods are only a part of the implementation methods of the present disclosure, not all of them. Based on the implementation methods in the present disclosure, all other implementation methods obtained by ordinary technical personnel in this field without creative labor fall within the scope of protection of the present disclosure.

Figure 1:
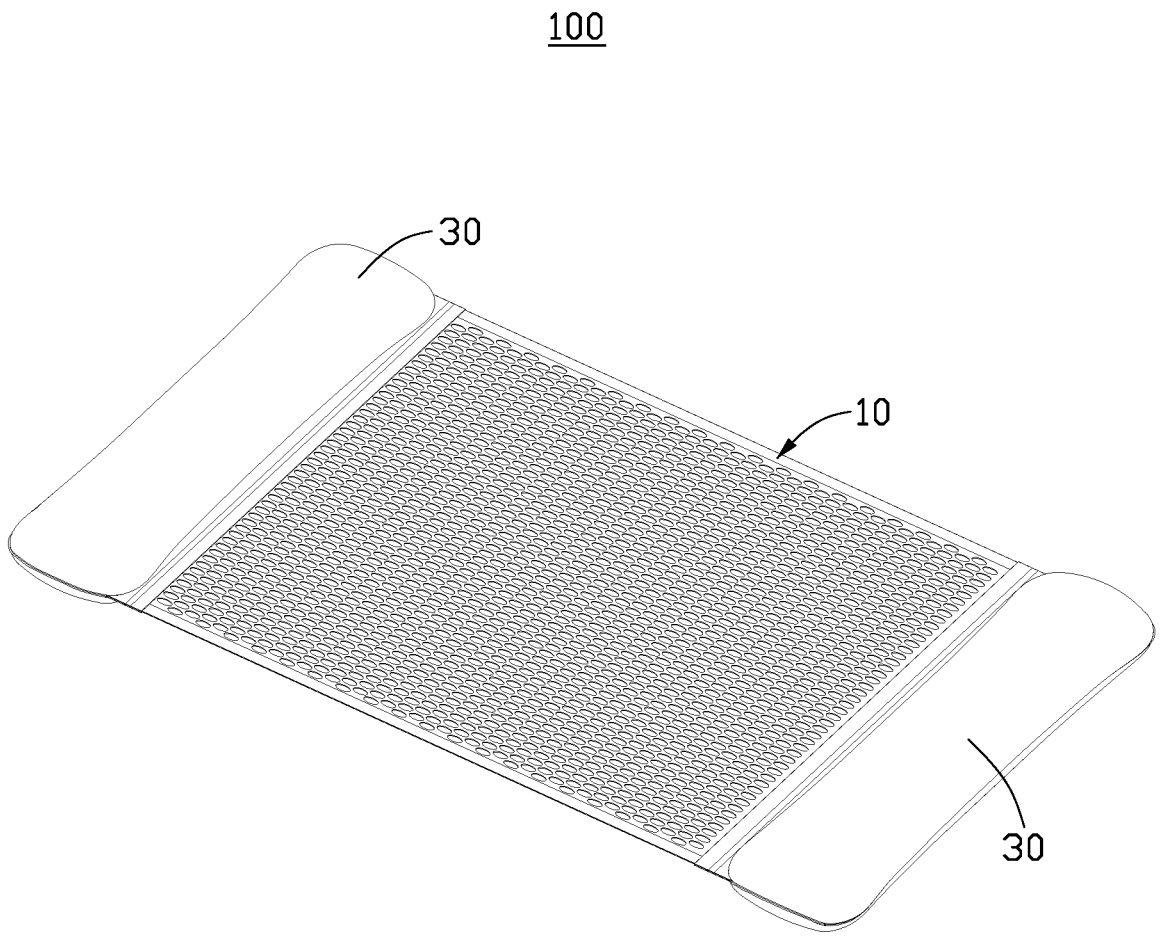
FIG. 1 is a three-dimensional structure diagram illustrating a floating device in an inflated state according to a first embodiment of the present disclosure.
Figure 2:
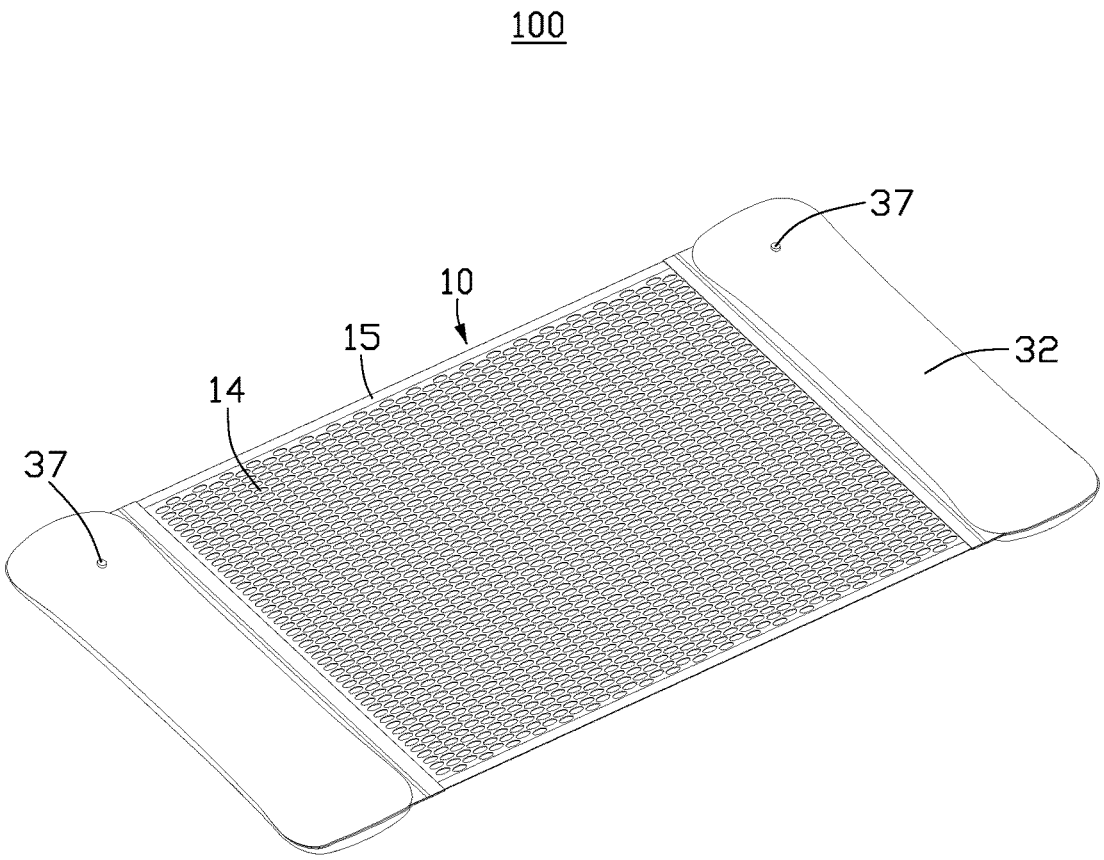
FIG. 2 is a three-dimensional structure diagram illustrating the floating device shown in FIG. 1 viewed from another angle.
Figure 3:
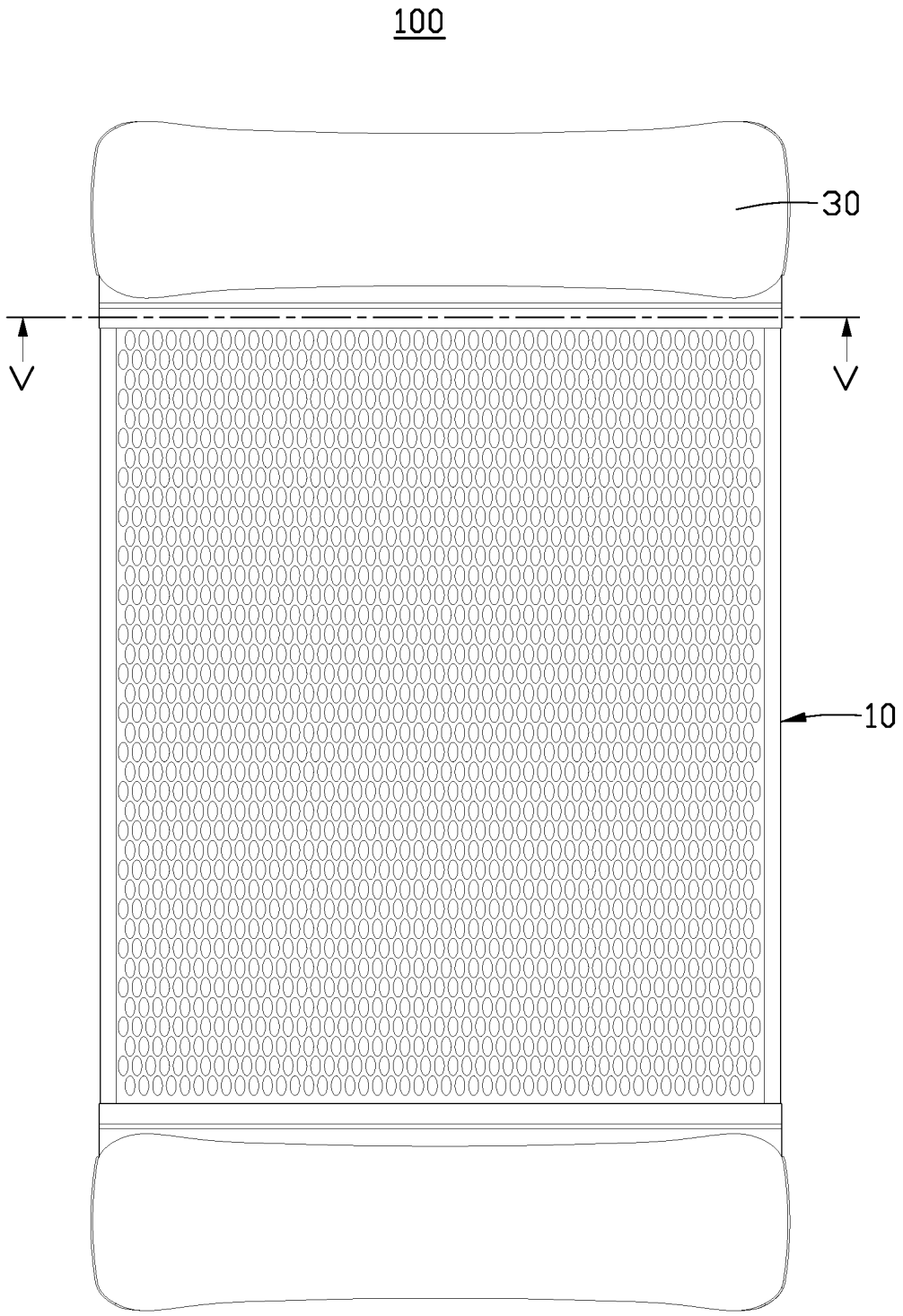
FIG. 3 is a top view of the floating device shown in FIG. 1.
Figure 4:
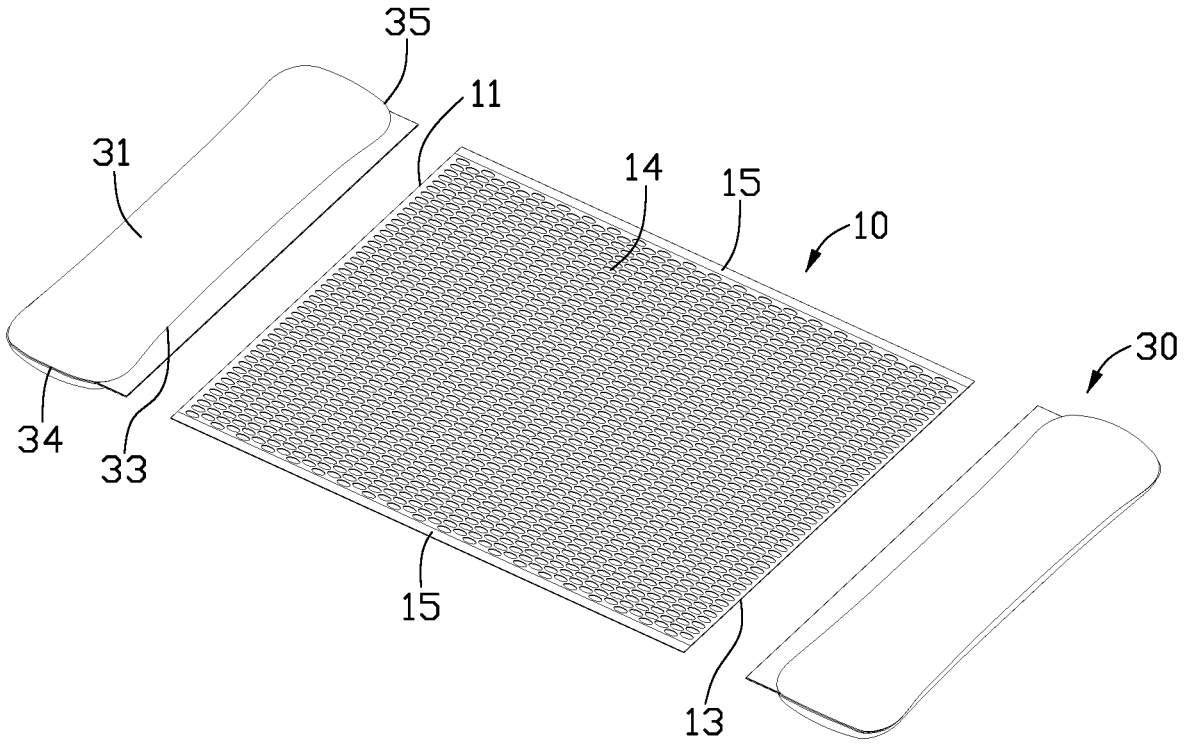
FIG. 4 is an exploded schematic diagram illustrating the floating device shown in FIG. 1.
Figure 5:
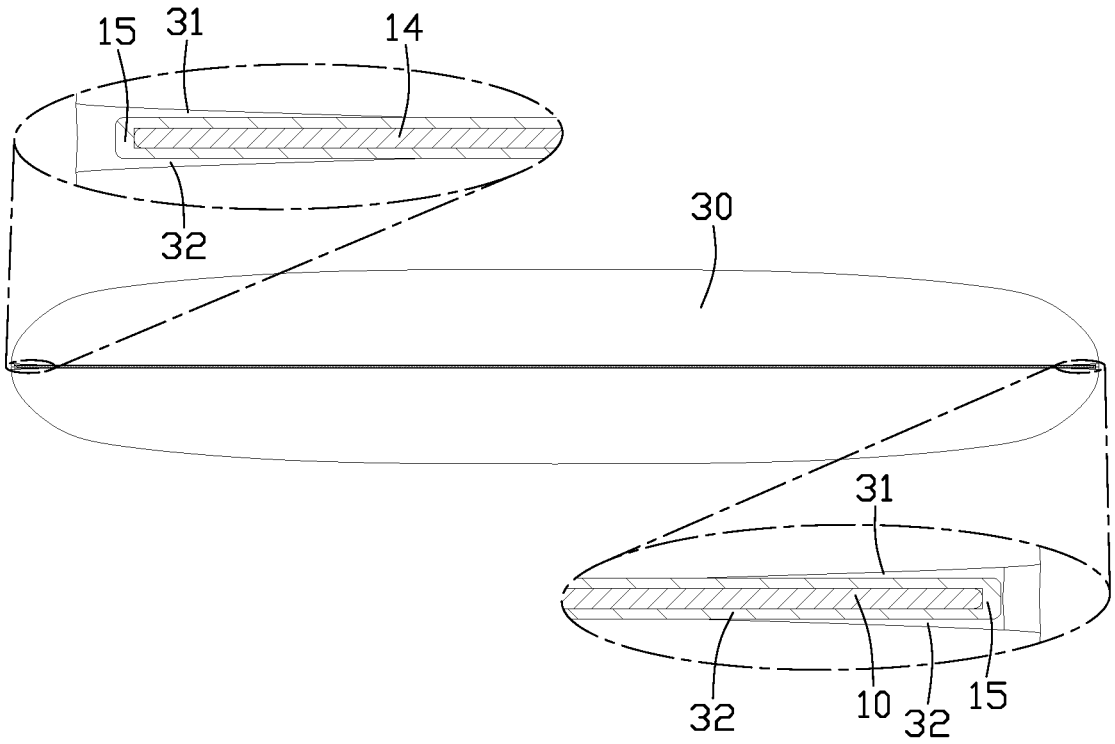
FIG. 5 is a cross-sectional view illustrating the floating device shown in FIG. 3 along a V-V view line.
Figure 6:
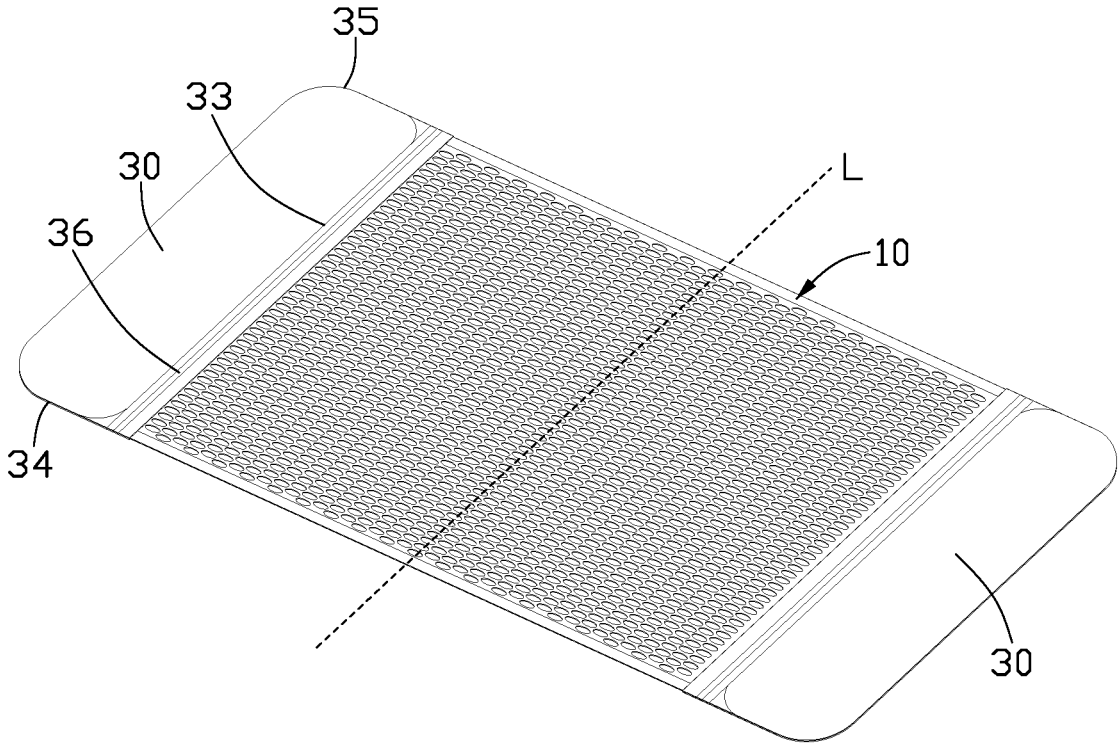
FIG. 6 is the three-dimensional structure diagram illustrating the floating device shown in FIG. 1 in a deflated state of the present disclosure.

Referring to FIGS. 1 to 5, the present disclosure provides a floating device 100, the floating device 100 includes a floating member 10 and a pair of inflatable members 30. The pair of inflatable members 30 are respectively attached to two opposite ends of the floating member 10. The pair of inflatable members 30 is inflatable airbags, and the floating device 100 is capable of being in an inflated state (as shown in FIG. 1) and a deflated state (as shown in FIG. 6). So that in the inflated state, even if a user lies on the floating device 100, the floating device 100 can still float on the water due to a buoyancy force exerted on the pair of inflatable members 30.

In other embodiment, the quantity of the inflatable member 30 can be 1 or more, which is not limited herein.

The floating member 10 includes a first end 11 and a second end 13 arranged opposite to the first end 11, the first end 11 is connected to one of the pair of inflatable members 30, and the second end 13 is connected to the other one of the pair of inflatable members 30. In this embodiment, the floating member 10 can be for example a substantially rectangular sharp. In other embodiments, the floating member 10 may be of other shapes, which is not limited herein.

In this embodiment, the floating member 10 includes a cloth 14 and at least one cladding member 15, the cloth 14 defines a plurality of holes and forms a network structure, the at least one cladding member 15 covers respective edge of the cloth 14, so as to protect the side edge of the cloth 14 and prevent the cloth 14 from being cracked.

In other embodiment, the cloth 14 may consist of a layer of plastic material, which is not limited herein.

Each of the pair of inflatable members 30 is formed by a single sheet and includes a sealed cavity: The inflatable member 30 includes an upper wall 31 and a lower wall 32 formed by bending the single sheet, the upper wall 31 and the lower wall 32 overlap with each other. In this embodiment, the sealed cavity is formed by connecting a first free edge 310 of the upper wall 31 to a second free edge 320 of the lower wall 32. In this embodiment, the upper wall 31 faces upward and the lower wall 32 faces the water when the floating device 100 is located on the water.

Figure 8:
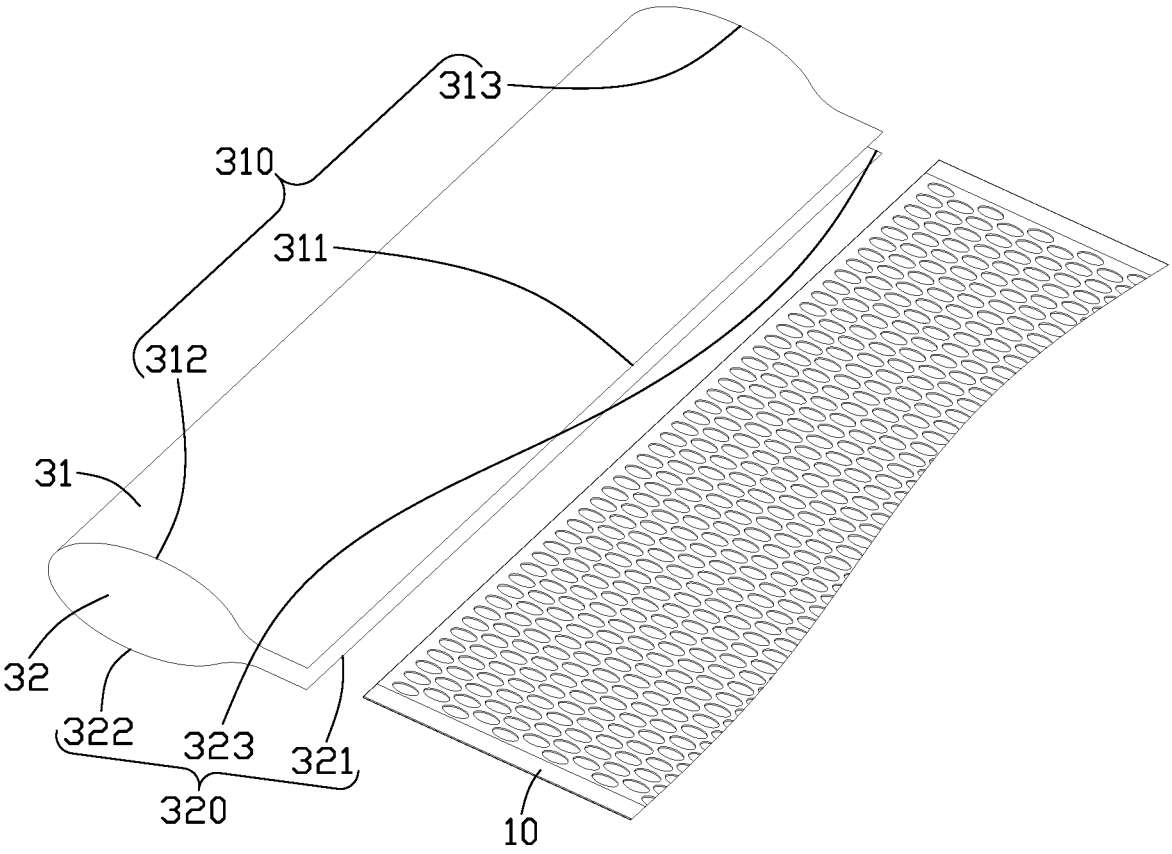
FIG. 8 is a three-dimensional structure diagram illustrating the floating device before an inflatable member is fused the present disclosure.

As shown in FIG. 8, the first free edge 310 of the upper wall 31 includes a first connecting edge 311, a first upper edge 312 and a second upper edge 313, both ends of the first connecting edge 311 are respectively connected to the first upper edge 312 and the second upper edge 313. The second free edge 320 of the lower wall 32 includes a second connecting edge 321, and a first lower side edge 322 and a second lower side edge 323, both ends of the second connecting edge 321 are respectively connected to the first lower side edge 322 and the second lower side edge 323, the first end 11 and the second end 13 are sandwiched between the first connecting edge 311 and the second connecting edge 321, and the clamping the cloth 14, the first connecting edge 311 and the second connecting edge 321 are fixedly connected.

Specifically; the floating device 10 further includes a first connected portion 33, a second connected portion 34, and a third connected portion 35. The first connecting edge 311 of the upper wall 31 and the second connecting edge 321 of the lower wall 32 may be connected together at their inner peripheries by any conventional heat welding technique to form the first connected portion 33, the first upper edge 312 of the upper wall 31 and the first lower edge 322 of the lower wall 32 may be connected together by any conventional heat welding technique to form the second connected portion 34, the second upper edge 313 of the upper wall 31 and the second lower edge of the lower wall 32 may be connected together by any conventional heat welding technique to form the third connected portion 35, and the sealed cavity is formed by connecting the second connected portion 34 and the third connected portion 35 to the corresponding side of the first connected portion 33 respectively.

In addition, at least one of the second connected portion 34 and the third connected portion 35 is arc shaped. Referring to FIG. 6, in this embodiment, both of the second connected portion 34 and the third connected portion 35 are arc shaped, and the inflatable member 30 is rectangle-shaped when in the deflated state, so that the floating device 100 is more attractive when in the inflated state.

In addition, the second connected portion 34 or/and the third connected portion 35 can be arc shaped, the corners of the inflatable member 30 can be more fullness when in the inflated state, and the overall appearance of the inflatable member 30 can be more beautiful.

In this embodiment, the floating device 100 further includes a fourth connected portion 36, the first connecting edge 311 of the upper wall 31, the second connecting edge 321 of the lower wall 32 and the first end 11 of the floating member 10 may be connected together to form the fourth connected portion 36, and the first connecting edge 311 of the upper wall 31, the second connecting edge 321 of the lower wall 32 and the second end 13 of the floating member 10 also may be connected to form the fourth connected portion 36, the fourth connected portion 36 is closer to a centerline L in a length direction of the floating device 100 than the first connected portion 33.

In other embodiments, the first connecting edge 311 of the upper wall 31, the second connecting edge 321 of the lower wall 32, and the first end 11 or the second end 13 of the floating member 10 may also be connected directly to form the fourth connected portion 36, and both ends of the fourth connected portion 36 are respectively connected to the second connected portion 34 and the third connected portion 35 to form the sealed cavity, that is the first connected portion 33 can be omitted, which is not limited herein.

In the present embodiment, the fourth connected portion 36 is parallel to the first connected portion 33.

Figure 7:
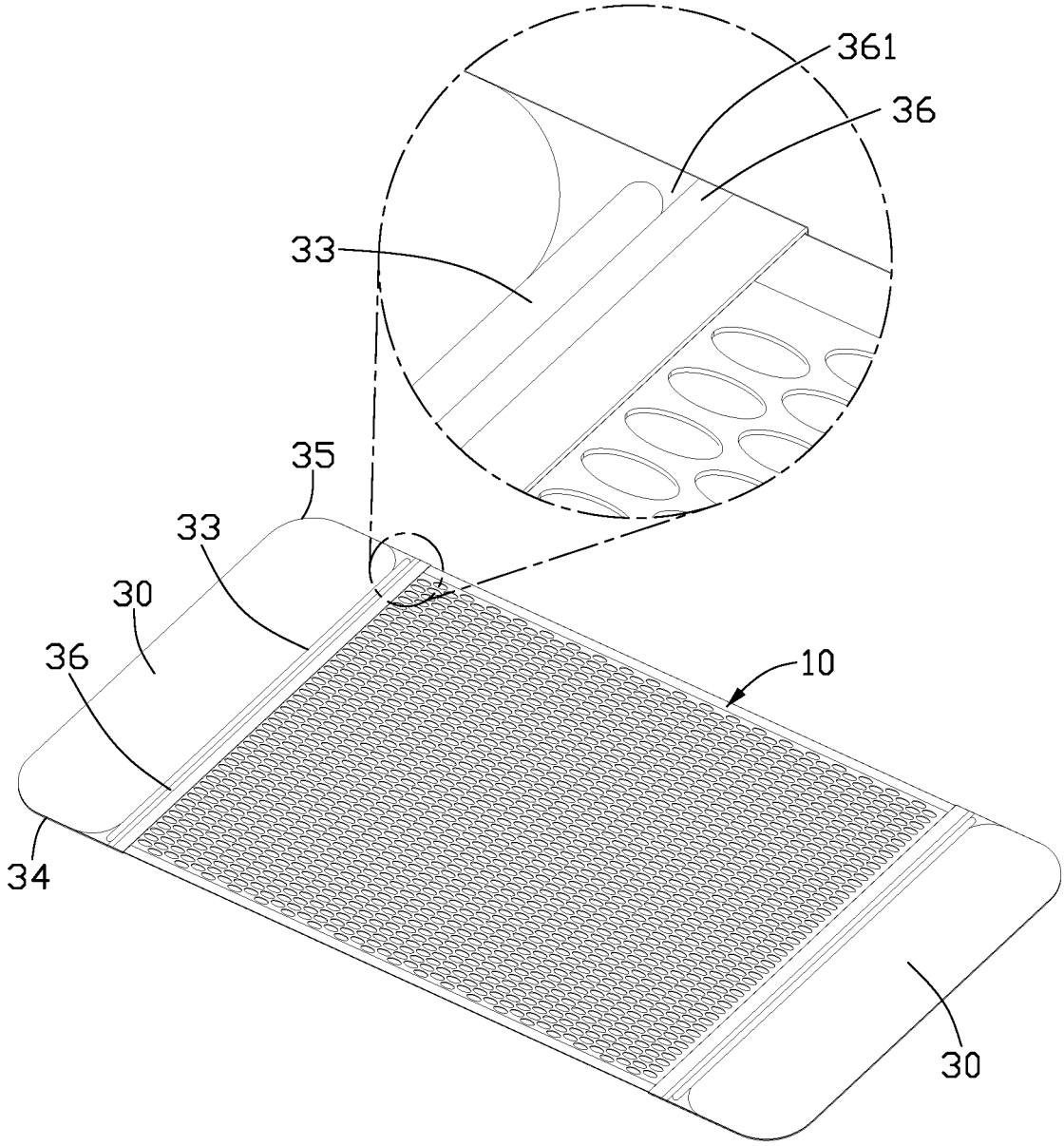
FIG. 7 is a three-dimensional structure diagram illustrating another embodiment of the floating device in a deflated state, and an enlarge view of a portion of the floating device.

In other embodiments, as shown in FIG. 7, a bend portion 361 is formed at each end of the fourth connected portion 36, each of the bend portion 361 is connected to a corresponding end of the first connected portion, that is, the fourth connected portion 36 and the first connected portion 33 form an approximate rectangular shape or an oval shape, which is not limited herein.

Further, the floating device 100 includes a pair of intake components 37 respectively installed on the pair of inflatable members 30. The position of the intake component 37 is not limited and may be located at any suitable position of the inflatable member 30, as long as the intake component 37 can inflate or deflate the inflatable member 30. In this embodiment, the intake component 37 is an air valve.

Compared with the prior art in which a plurality of sheets are connected together to form an inflatable member, the inflatable member 30 of the present disclosure is composed of the single sheet, the structure of the inflatable member 30 is simple, and it can quickly align with the upper wall 31 and the lower wall 32 during the manufacturing process, thereby improving the production efficiency.

Figure 9:
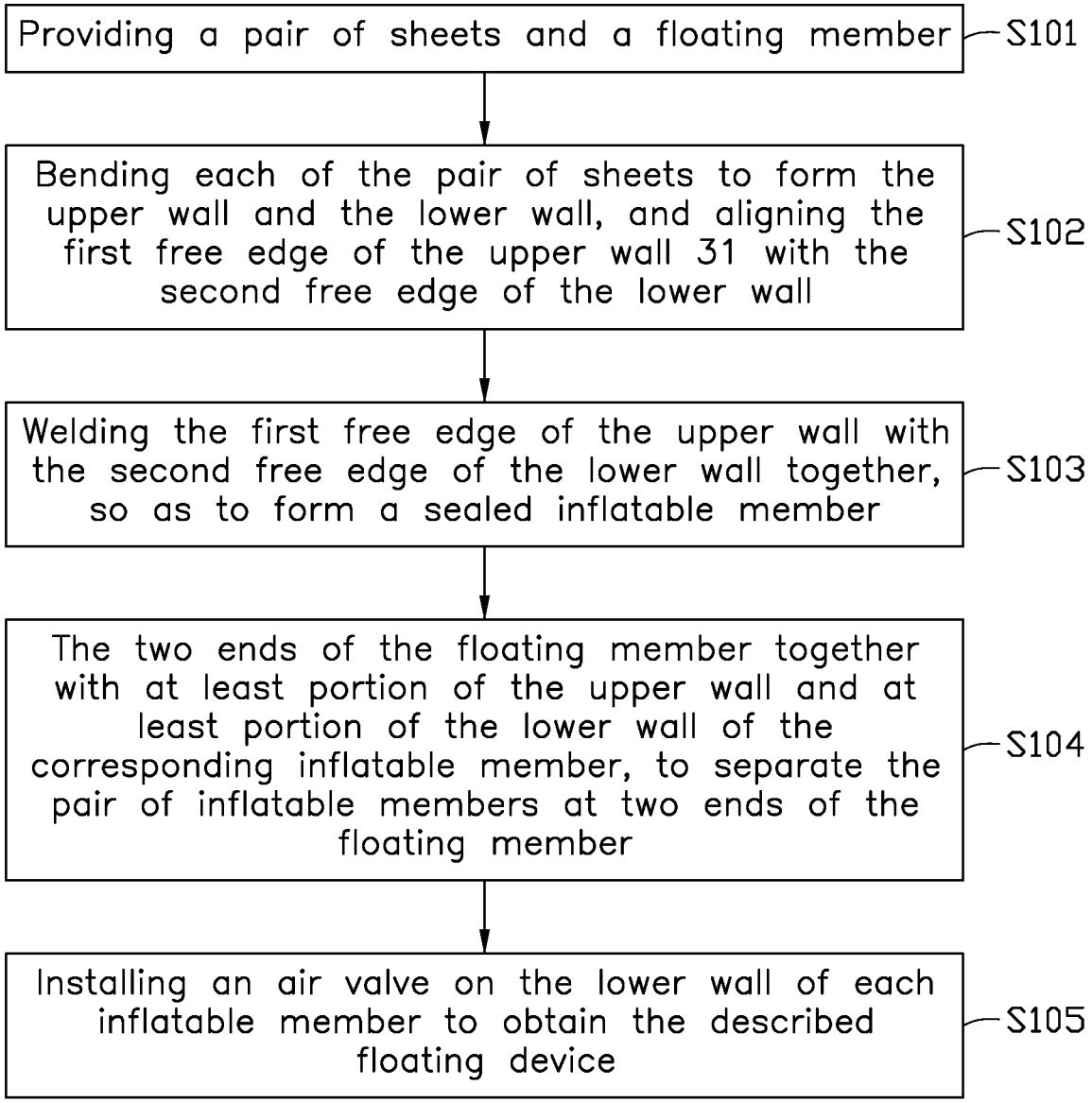
FIG. 9 is a manufacturing process diagram illustrating making of the floating device of the present disclosure.

Referring to FIG. 9, the present disclosure also provides a method for manufacturing the floating device 100 described above.

Step S101, providing a pair of sheets and a floating member 10.

The floating member 10 includes the cloth 14 and the cladding member 15. The floating member 10 is formed by wrapping the cladding 15 on each long side of the cloth 14 and welding the cladding member 15 and the cloth 14 together.

Step S102, bending each of the pair of sheets to form the upper wall 31 and the lower wall 32, and aligning the first free edge 310 of the upper wall 31 with the second free edge 320 of the lower wall 32.

In this embodiment, the first free edge 310 of the upper wall 31 includes the first connecting edge 311, the first upper edge 312 and the second upper edge 313, both ends of the first connecting edge 311 are respectively connected to the first upper edge 312 and the second upper edge 313. The second free edge 320 of the lower wall 32 includes the second connecting edge 321, and the first lower side edge 322 and the second lower side edge 323, both ends of the second connecting edge 321 are respectively connected to the first lower side edge 322 and the second lower side edge 323.

Step S103, welding the first free edge 310 of the upper wall 31 with the second free edge 320 of the lower wall 32 together, so as to form a sealed inflatable member.

Specifically, in this embodiment, the first connecting edge 311 of the upper wall 31 and the second connecting edge 321 of the lower wall 32 may be connected together at their inner peripheries to form the first connected portion 33, the first upper edge 312 of the upper wall 31 and the first lower edge 322 of the lower wall 32 are connected together form the second connected portion 34, the second upper edge 313 of the upper wall 31 and the second lower edge of the lower wall 32 are connected together to form the third connected portion 35, the second connected portion 34 and the third connected portion 35 are connected to both sides of the first connected portion 33, so as to form the sealed cavity.

Step S104, welding the two ends of the floating member 10 with at least portion of the upper wall 31 and at least portion of the lower wall 32 of the corresponding inflatable member 30, so as to the pair of inflatable members 30 are respectively connected to two ends of the floating member 10.

In this embodiment, the first connecting edge 311 of the upper wall 31, the second connecting edge 321 of the lower wall 32 and the first end 11 of the floating member 10 are connected together to form a fourth connected portion 36, and the first connecting edge 311 of the upper wall 31, the second connecting edge 321 of the lower wall 32 and the second end 13 of the floating member 10 also are connected together to form the fourth connected portion 36, the fourth connected portion 36 is closer to a centerline L in a length direction of the floating device 100 than the first connected portion 33.

In the present embodiment, the fourth connected portion 36 is parallel to the first connected portion 33.

In this embodiment, the edges are connected by any conventional heat welding technique, which is not limited herein.

In other embodiments, two ends of the fourth connected portion 36 may also be connected to two ends of the first connected portion 33 respectively, that is, the fourth connected portion 36 and the first connected portion 33 form an approximately rectangular-shaped structure, which is not limited herein.

Step S105, installing a pair of intake components 37 on the lower wall 32 of pair of inflatable members 30 respectively to obtain the described floating device 100.

The order of the steps S101 to S105 may be arbitrarily adjusted according to requirements, which is not limited herein.

Compared with the prior art, in the method for manufacturing the floating device 100 of the present disclosure, the upper wall 31 and the lower wall 32 of the inflatable member 30 are formed by bending the single sheet, and the first free edge 310 of the upper wall 31 and the second free edge 320 of the lower wall 32 are fused by means of fusion to form the sealed cavity, the structure of the inflatable member 30 is simple, the procedure of the inflatable member 30 can be effectively reduced, and the manufacturing cost is further reduced.

In addition, those skilled in the art should understand that the above embodiments are only used to illustrate the present disclosure, but not used to limit the present disclosure, and appropriate changes and modifications made to the above embodiments belong to the scope of the disclosure of the present disclosure as long as they are within the scope of the substantive spirit of the present disclosure.

What is claimed is:

1. A floating device, comprising:

a floating member comprising a first end and a second end arranged opposite the first end; and a pair of inflatable members attached to the first end and the second end of the floating member respectively and configured to be inflatable, wherein each of the pair of inflatable members is formed by a single sheet and comprises an upper wall and a lower wall formed by bending the single sheet, the upper wall and the lower wall of each inflatable member overlap each other, a sealed cavity is formed by connecting a first free edge of the upper wall to a second free edge of the lower wall, the first end and the second end are sandwiched between the upper wall and the lower wall of a corresponding one of the pair of inflatable members, each of the pair of inflatable members comprises a first connected portion and a fourth connected portion, the first connected portion and the fourth connected portion are located on the same side of each of the pair of inflatable members, the first connected portion is formed by connecting the upper wall and the lower wall, the fourth connected portion is formed by connecting the upper wall, the lower wall and the corresponding one of the first end and the second end, such that the first end and the second end are respectively connected to the upper wall and the lower wall, and the fourth connected portion is separated from the first connected portion.

2. The floating device according to claim 1, wherein the first free edge of the upper wall comprises a first connecting edge, a first upper edge and a second upper edge, both ends of the first connecting edge are respectively connected to the first upper edge and the second upper edge, the second free edge of the lower wall comprises a second connecting edge, and a first lower side edge and a second lower side edge, both ends of the second connecting edge are respectively connected to the first lower side edge and the second lower side edge, the floating device further comprises a second connected portion and a third connected portion, wherein the first connecting edge of the upper wall and the second connecting edge of the lower wall are connected together to form the first connected portion, the first upper edge of the upper wall and the first lower side edge of the lower wall are connected together to form the second connected portion, the second upper edge of the upper wall and the second lower side edge of the lower wall are connected together to form the third connected portion, and the sealed cavity is formed by connecting the second connected portion to one side of the first connected portion and the third connected portion to the other side of the first connected portion.

3. The floating device according to claim 2, wherein at least one of the second connected portion and the third connected portion is arc-shaped.

4. The floating device according to claim 1, wherein the fourth connected portion is parallel to the first connected portion.

5. The floating device according to claim 1, wherein a bend portion is formed at each end of the fourth connected portion, each of the bend portion is connected to a corresponding end of the first connected portion.

6. The floating device according to claim 1, wherein the floating device further comprises a pair of intake components respectively installed on the pair of inflatable members.

7. The floating device according to claim 1, wherein the floating device further comprises a cloth defining a plurality of holes.

8. The floating device according to claim 7, wherein the floating device further comprises at least one cladding member, the at least one cladding member is configured to cover an edge of the cloth that is not connected to the inflatable member.

9. A floating device comprising:

a floating member; and at least one inflatable member arranged on the floating member and configured to be inflatable, wherein the at least one inflatable member is formed by bending a single sheet, each of the at least one inflatable member comprises a sealed cavity, the at least one inflatable member is equipped with an intake component, each of the at least one inflatable member comprises an upper wall and a lower wall by bending the single sheet, and the upper wall and the lower wall of each of the at least one inflatable member overlap each other, the sealed cavity is formed by connecting a first free edge of the upper wall to a second free edge of the lower wall, the floating member comprises at least one connected end sandwiched between the upper wall and the lower wall of the corresponding one of the at least one inflatable member, each of the at least one inflatable member comprises a first connected portion and a fourth connected portion, the first connected portion and the fourth connected portion are located on the same side of each of the at least one inflatable member, the first connected portion is formed by connecting the upper wall and the lower wall, the fourth connected portion is formed by connecting the upper wall, the lower wall and the corresponding one of the at least one connected end, such that the at least one connected end is connected to the upper wall and the lower wall, the fourth connected portion is separated from the first connected portion.

10. The floating device according to claim 9, wherein the first free edge of the upper wall comprises a first connecting edge, a first upper edge and a second upper edge, both ends of the first connecting edge are respectively connected to the first upper edge and the second upper edge, the second free edge of the lower wall comprises a second connecting edge, and a first lower side edge and a second lower side edge, both ends of the second connecting edge are respectively connected to the first lower side edge and the second lower side edge, the floating device further comprises a second connected portion and a third connected portion, wherein the first connecting edge of the upper wall and the second connecting edge of the lower wall are connected together to form the first connected portion, the first upper edge of the upper wall and the first lower side edge of the lower wall are connected together to form the second connected portion, the second upper edge of the upper wall and the second lower side edge of the lower wall are connected together to form the third connected portion, and the sealed cavity is formed by connecting the second connected portion to one side of the first connected portion and the third connected portion to the other side of the first connected portion.

11. The floating device according to claim 10, wherein at least one of the second connected portion and the third connected portion is arc-shaped.

* * * * *